United States Patent [19]

Kohler et al.

[11] 4,267,226

[45] May 12, 1981

[54] FABRIC WEB AND A METHOD OF MAKING A FABRIC WEB FOR A DEWATERING MACHINE

[75] Inventors: Ernst Kohler; Friedrich Moninger, both of Eislingen, Fed. Rep. of Germany

[73] Assignee: Wurttembergische Filztuchfabrik, Goppingen, Fed. Rep. of Germany

[21] Appl. No.: 76,688

[22] Filed: Sep. 19, 1979

[51] Int. Cl.[3] ..... D21F 1/10

[52] U.S. Cl. ..... 428/223; 139/383 A; 162/DIG. 1; 162/348; 162/358; 24/38; 474/253; 428/192; 428/257

[58] Field of Search ..... 162/348, 358, DIG. 1; 139/383 A, 425 A; 474/255, 256, 257, 258, 259, 260, 261; 428/192, 223, 257; 24/31 C, 31 H, 38

[56] References Cited

U.S. PATENT DOCUMENTS

| | | | |
|---|---|---|---|
| 3,900,659 | 8/1975 | MacBean | 428/223 |
| 4,035,872 | 7/1977 | MacBean | 24/31 H |
| 4,095,622 | 6/1978 | MacBean | 139/383 A |
| 4,182,381 | 1/1980 | Gisbourne | 139/383 A |

FOREIGN PATENT DOCUMENTS

| | | | |
|---|---|---|---|
| 2806742 | 9/1978 | Fed. Rep. of Germany | 162/348 |
| WO79/00026 | 1/1979 | PCT Int'l Appl. | 139/383 A |

*Primary Examiner*—Henry Jaudon
*Attorney, Agent, or Firm*—Kenyon & Kenyon

[57] ABSTRACT

The ends of the web are provided with curved connecting members which are formed by longitudinal filaments which are of greater cross-section than the remaining filaments of the web. These larger sized longitudinal filaments are inserted into the end portions of the web ends in place of the usual longitudinal filaments. The overlapping portions of the layers of the fabric web are provided with zones free of transverse filaments and the layers are secured together in the zones by a manually inserted transverse filament.

22 Claims, 5 Drawing Figures

FABRIC WEB AND A METHOD OF MAKING A FABRIC WEB FOR A DEWATERING MACHINE

This invention relates to a fabric web and a method of making a fabric web for for a dewatering machine. More particularly, this invention relates to a fabric web for a drying section of a paper, paperboard, or cellulose dewatering machine.

As is known, various types of fabric webs have been used for covering the drying sections of paper, paperboard and cellulose dewatering machines. Generally, these webs have been provided with spaced apart curved connecting members at the ends for mutually movable joining of the web ends.

In some cases, the curved connecting members are made up of metal hooks or loops which are pressed or fastened into the web ends to be joined by means of a fastening rod. Instead of using individual metal connecting members, use can also be made of a wire helix which is drawn into the ends of the fabric web. When such connecting members are used, the edges of the fabric web should be turned over. However, this results in a densification of the fabric which, in turn, impairs the permeability and porosity of the fabric web. This is especially disadvantageous when the fabric webs are used as a covering for the drying section of paper machines. In addition, the metal connecting elements are imaged on the paper due to the pressure being applied and, thus, leave undesirable marks. The most severe disadvantage of such metal connecting members, however, is their relatively short working life. Thus, they must be replaced on the fabric webs repeatedly. This involves a high labor expense and has the drawback that the ends of the web are subjected to additional stress.

These disadvantages could be overcome, in a known fabric web of the prior art, by having longitudinal filaments of a fabric layer form the curved connecting members. In this case, a zone free of transverse filaments is also left in the fabric layer and the fabric layer is bent back in this zone. In this way, the longitudinal filaments are reshaped to provide curved connecting members. In this embodiment, the prerequisites for a correspondingly improved joining arrangement could thus be provided via textile technology. However, despite the advantages gained, even this joining arrangement is unsatisfactory with respect to wear endurance, inasmuch as the curved connecting members are made up of longitudinal or chain filaments of a fabric layer, and when these break, it is not possible to replace them. Thus, the entire fabric web becomes unusable.

Accordingly, it is an object of the invention to provide a fabric web for a dewatering machine which has an improved joining arrangement.

It is another object of the invention to provide a joining arrangement for a fabric web for a dewatering machine which has a useful life equal to the life of the fabric web.

It is another object of the invention to provide a simple method for making fabric webs with integral connecting members at the ends.

Briefly, the invention provides a fabric web for a drying section of a paper, paperboard or cellulose dewatering machine and a method of making such a fabric web.

The fabric web is comprised of at least two interwoven fabric layers formed of longitudinal and transverse filaments with one of the layers having an end portion at each end. Each end portion has a plurality of longitudinal filaments of greater cross-section than the remainder of the longitudinal filaments. Each end portion containing the filaments of greater cross-section is folded back and each folded back end portion and the filaments of greater cross-section contained therein are secured to the other layer. The folded back and secured filaments of greater cross-section form a plurality of spaced apart curved connecting members at each end.

When secured in place, the respective ends of the fabric web are brought together so that the connecting members at each end are interposed with the connecting members at the other end. Thereafter, a fastening rod is slidably disposed within the interposed connecting members to secure the ends of the web together.

The method of making the fabric web comprises the steps of providing at least two interwoven fabric layers formed of longitudinal and transverse filaments with one of the layers having a zone free of transverse filaments spaced from and parallel to a leading edge thereof and with the layers being separated from each other between this zone and the leading edges thereof. In addition, the method includes the steps of introducing a plurality of longitudinal filaments of greater cross-section than the remainder of the longitudinal filaments in the layers into one fabric layer upstream of the transverse filament free zone and extending these filaments through the zone and thence into the other layer downstream of this zone. Thereafter, a portion of one layer adjacent to the leading edge is removed and the end portion of the other layer containing the larger filaments is folded back into overlapping relation with the transverse filament free zone. This causes the longitudinal filaments of greater cross-section to form the spaced apart curved connecting members. Thereafter, the folded back end portion of the layer and the filaments of greater cross-section contained therein are joined to the other layer.

The longitudinal filaments of greater cross-section preferably replace one, some or all of the remainder of the longitudinal filaments of the one layer in the folded back end portion.

The longitudinal filaments which form the curved connecting members in the fabric web exhibit a severalfold higher tensile strength than the tensile strength of the remaining longitudinal filaments. Thus, by replacing longitudinal filaments with others having a larger cross-section, the fabric density is maintained, i.e., a densification in the region of the ends of the web is avoided. As a result, the fabric remains uniformly porous over the entire length of the leading edges of the fabric web. At the same time, the spacing of the transverse filaments can also be slightly increased, especially if the cross-section of the longitudinal filaments which form the connecting members is chosen to be relatively large; this will assure the desired fabric density.

It is also essential in such fabric webs that they display a high flexibility in the edge region to prevent the possibility of producing markings on the paper web which lies upon the fabric web as the edges of the fabric web which are joined to each other are turned. Therefore, in a further advantageous embodiment of the fabric web, a zone free of transverse filaments is provided in one layer of fabric some distance from and parallel to the leading edge and the other fabric layer which has the curved connecting members is joined to the first fabric layer at the zone free of transverse filaments. Experiments have shown that the arrangement of a zone free of transverse filaments behind the leading edges of the fabric web not only substantially increases the flexibility of the edge region, but that this improved flexibility of the fabric also has an advantageous effect on the useful life of the connecting members. Thus, it becomes possible, in this way, to reduce to some extent the cross-section of the longitudinal filaments which form the connecting members to achieve a desired working life. In doing this, it is favorable if a zone free of transverse filaments is also provided in the fabric layer which carries the connecting members in spaced parallel relation to the leading edge. This zone is overlapped with the zone free of transverse filaments in the other fabric layer and is joined thereto.

The thicker longitudinal filaments for forming the curved connecting members can consist of a monofilament or multifilament core and can be coated or clad with a chemically resistant plastic. The plastic coating is also suitably made of high temperature resistant polymers, e.g. polyvinylidene fluoride, polytetrafluoroethylene or similar modified plastics, while the core (interior filament) can be made of twisted aromatic, high temperature resistant polyamides.

To the extent that the fabric web comprises at least three fabric layers, an advantageous construction results if the longitudinal filaments which have a larger cross section and serve to form the connecting members are bound into one outer fabric layer ahead of the transverse filament free zone, passed through the middle fabric layer, and led through into the other outer fabric layer; if the middle fabric layer has an end portion at the edge made with fiber-spun transverse filaments in a linen weave; and finally if the outer fabric layer which forms the connecting members is bent back over the middle fabric layer and is joined to the other outer fabric layer.

These and other objects and advantages of the invention will become more apparent from the following detailed description and appended claims taken in conjunction with the accompanying drawings in which:

Figure 1:
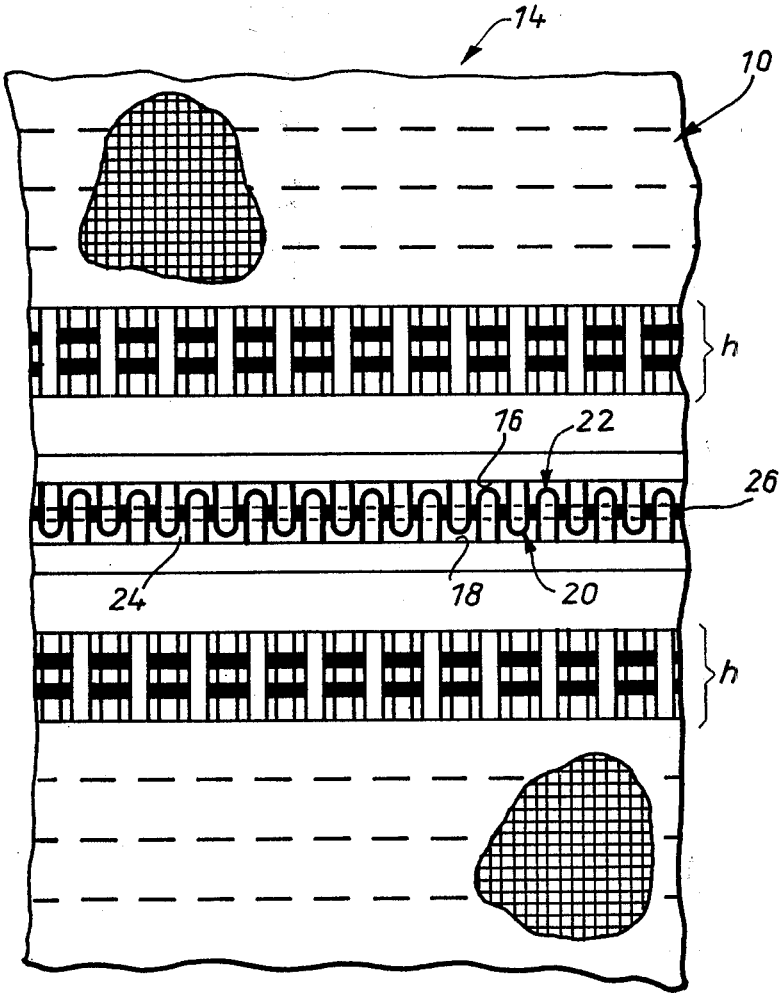
FIG. 1 illustrates a partial plan view of two joined web ends of a fabric web having three fabric layers in accordance with the invention.
Figures 2, 3, 4, 5:
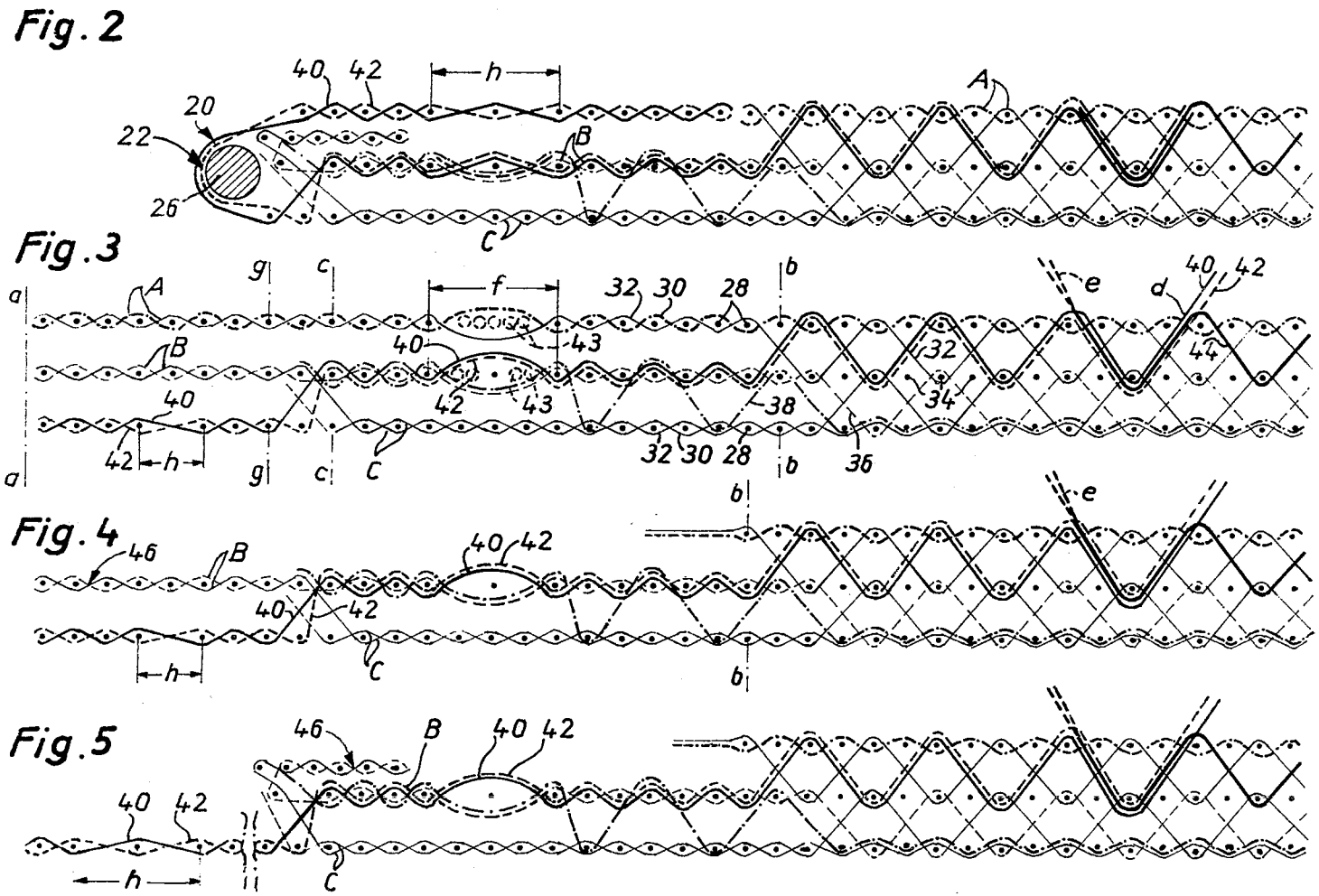
FIG. 2 illustrates a partial sectional view through one end of the fabric web of FIG. 1.
FIG. 3 illustrates a longitudinal sectional view through one end piece of a fabric web in a first phase of manufacture in accordance with the invention.
FIG. 4 illustrates a longitudinal sectional view corresponding to FIG. 3 in a second phase of manufacture.
FIG. 5 illustrates a view similar to FIG. 4 in a third phase of manufacture in accordance with the invention.

Referring to FIGS. 1 and 2, the fabric web 14 is intended, for example, for the drying section of a paper machine and has two ends 10, 12 which are interconnected with respect to each other. To this end, each end of the web has curved connecting members 20, 22 at the leading edges 16, 18 which are equi-spaced from each other. As indicated, the connecting members are interposed with respect to each other within respective gaps 24 between the connecting members 20, 22 of each end 10, 12. The connecting members 20, 22 collectively define an insertion channel into which a fastening rod 26, for example made of plastic is slidably mounted and axially secured.

Referring to FIG. 3, the fabric web 14 is made of a tubular fabric which comprises a total of three fabric layers A, B, C. The two outer fabric layers A, C consist of transverse filaments 28 and longitudinal filaments 30, 32 which are woven around the transverse filaments 28 in opposite directions and extend to the end of the web 14 (line a—a). The middle fabric layer B, in the region of a web end, consists of sections with different longitudinal filaments. Longitudinal filaments 30, 32 from the two outer fabric layers A, C participate in forming the middle fabric layer B to a point (line b—b) upstream of the end of the web 14 and an additional longitudinal filament 36 of the outer fabric layer C is woven into the transverse filament 34, running in the opposite direction to the longitudinal filament 32 of fabric layer A. A portion of the middle fabric layer B (between lines b—b and c—c) is formed not only by the longitudinal filament 36 but also by three additional longitudinal filaments 38, 40 and 42, which run in the same direction and are woven around the transverse filament 34. The longitudinal filament 38 is woven, along a portion of its length, into transverse filaments 28 and 34, and along a further portion only into transverse filament 34 of fabric layer B.

As shown in FIG. 3, the longitudinal filaments 40, 42 are woven into the two fabric layers A, B at a relatively large distance from the web end (line a—a), and run in the same direction with a chain stitch 44 which binds the two fabric layers A, B together. The latter stitch 44 is led out shortly after the entrance of the two longitudinal filaments 40, 42 into upper fabric layer A and is cut off at a given point e.

The two longitudinal filaments 40, 42 are bound exclusively into the middle fabric layer B between the lines b—b and c—c, and beyond c—c are bound into the lower (as viewed) fabric layer C while running in mutually opposite directions. These longitudinal filaments 40, 42 have a cross-section which is greater than that of the remaining longitudinal filaments of all of the layers of fabric.

As shown in FIG. 3, a zone f free of transverse filaments is provided in both fabric layers A and B at a distance from the point of exit of the two longitudinal filaments 40, 42 from the lower fabric layer C. As shown by a dot-dash line, one or more transverse filament 43, made of soft, fiber-spun material, can later be worked into each zone f.

As mentioned above, the longitudinal filaments 40, 42 have a larger cross-section than the other longitudinal filaments of the fabric layers, and these filaments 40, 42 are only woven into the fabric web 14 at a relatively short distance from the end of the web. A portion of the other longitudinal filaments of smaller cross-section from the fabric layers A and B are exchanged for these larger filaments 40, 42, so that the permeability of the fabric web 14 in this region remains essentially unchanged.

In order to make the curved connecting members 20 and 22 used for the mutual connection of the two ends of the web, the tubular fabric is laterally separated in such a way that the two fabric layers A and B are separated from each other from line a—a to zone f and fabric layers B and C are separated from each other from line a—a to a line g—g downstream of line c—c. After this, as shown in FIG. 4, the upper fabric layer A is separated from the fabric web up to line b—b.

The end portion of the middle fabric layer B is made with fiber-spun transverse filaments in a linen weave, at least directly ahead of the insertion of longitudinal filaments 40, 42 into the lower fabric layer C, and is cut off in such a way that a residual piece 46 (FIG. 5) in linen weave can be folded back ahead of the connecting zone and can be secured to the remainder of the middle fabric layer, for example by sewing (FIG. 5). Now, to form the curved connecting members 20 or 22, the end portion of the fabric web C, which has a zone free of transverse filaments along one portion h (FIG. 4), is folded back in such a way as to lie above the middle fabric layer B. This end portion is then firmly joined to the other two fabric layers B, C by gluing and/or sewing. First, however, the zone h in the layer C which is free of transverse filaments and the zone f of the middle fabric layer B which is free of transverse filaments are overlapped and secured to each other, by manually working a transverse filament thereinto.

It is essential that the edge region of the fabric web be exceedingly flexible throughout zone h free of transverse filaments. Transverse filaments made of soft, fiber-spun material can likewise be worked into the zone h of the fabric layer C, which is free of transverse filaments. In this way, the surface of the fabric web 14 is caused to be largely of a closed nature in this particularly flexible region as well.

Inasmuch as the longitudinal filaments 40, 42 which form the curved connecting members 20,22 have a substantially greater cross-section than the other longitudinal filaments of the fabric layers, a strength is achieved in the connecting members which assures that these attain the same working life as the fabric web.

What is claimed is:

1. A fabric web for a drying section of a paper, paperboard and cellulose dewatering machine, said web comprising at least two fabric layers formed of longitudinal and transverse filaments, one of said layers having a plurality of longitudinal filaments of greater cross-section than the remainder of said longitudinal filaments at at least one end thereof, said one layer containing said longitudinal filaments of greater cross-section being folded back at said end, said folded back end of said layer and said longitudinal filaments of greater cross-section contained therein being secured to the other of said layers, said folded back and secured longitudinal filaments of greater cross-section forming a plurality of spaced apart curved connecting members at said end.

2. A fabric web as set forth in claim 1, wherein said longitudinal filaments of greater cross-section replace at least one of said remainder of longitudinal filaments of said one layer at said end.

3. A fabric web as set forth in claim 2, wherein said other layer has a zone free of transverse filaments spaced from and parallel to a leading edge thereof and said one layer is secured to said other layer at least in said zone.

4. A fabric web as set forth in claim 3, wherein said one layer has a zone free of transverse filaments spaced from and parallel to a leading edge thereof said zone of said one layer being overlapped with and secured to said zone of said other layer.

5. A fabric web as set forth in claim 2, wherein said longitudinal filaments of greater cross-section consist of a multi-filament core and a coating of chemically resistant plastic.

6. A fabric web as set forth in claim 5, wherein said coating is a high temperature resistant polymer and said core is a twisted aromatic high temperature resistant polyamide.

7. A fabric web as set forth in claim 6, wherein said polymer is selected from the group consisting of polyvinylidene flouride, polytetrafluoroethylene and polytrifluorochloroethylene.

8. A fabric web comprising at least three fabric layers formed of longitudinal and transverse filaments, an outer one of said layers having a plurality of longitudinal filaments of greater cross-section than the remainder of said longitudinal filaments at at least one end thereof, said longitudinal filaments of greater cross-section being bound into said other outer layer, passed through a middle layer of said layers and led into said one outer layer, said one layer containing said filaments of greater cross-section being folded back at said end thereof, said folded back end of said one layer and said longitudinal filaments of greater cross-section contained therein being secured to the other outer layer, said folded back and secured filaments of greater cross-section forming a plurality of spaced apart curved connecting members at said end.

9. A fabric web as set forth in claim 8, wherein said longitudinal filaments of greater cross-section replace at least one of said remainder of longitudinal filaments of said one layer at said one end.

10. A fabric web as set forth in claim 9, wherein each of said outer one layer and said middle layer has a zone free of transverse filaments spaced from and parallel to a leading edge thereof, said zones being overlapped and secured to each other.

11. A fabric web as set forth in claim 10, wherein said middle layer has an end portion at said edge formed of a linen weave with fiber-spun transverse filaments, said end portion being folded back and secured to the remainder of said middle layer ahead of said zones of said outer layers.

12. A fabric web as set forth in claim 9, wherein said longitudinal filaments of greater cross-section consist of a multi-filament core and a coating of chemically resistant plastic.

13. A fabric web for a dewatering machine, said web comprising at least two interwoven fabric layers formed of longitudinal and transverse filaments, one of said layers having an end portion at each end having a plurality of longitudinal filaments of greater cross-section than the remainder of said longitudinal filaments, said end portions of said one layer containing said longitudinal filaments of greater cross-section being folded back, said folded back end portions of said layer and said longitudinal filaments of greater cross-section contained therein being secured to the other of said layers, said folded back and secured longitudinal filaments of greater cross-section forming a plurality of spaced apart curved connecting members at each end.

14. A fabric web as set forth in claim 13, wherein said longitudinal filaments of greater cross-section replace at least one of said remainder of said longitudinal filaments in each of said end portions.

15. In combination, a fabric web comprising at least two interwoven fabric layers formed of longitudinal and transverse filaments, one of said layers having an end portion at each end having a plurality of longitudinal filaments of greater cross-section than the remainder of said longitudinal filaments, said end portions of said one layer containing said longitudinal filaments of greater cross-section being folded back, said folded back end portions of said layer and said longitudinal filaments of greater cross-section contained therein being secured to the other of said layers, said folded back and secured longitudinal filaments of greater cross-section forming a plurality of spaced apart curved connecting members at each end, said connecting members at each end being interposed between said connecting members at the other end; and a fastening rod slidably disposed within said interposed connecting members to secure said ends of said web together.

16. A fabric web as set forth in claim 15, wherein said longitudinal filaments of greater cross-section replace at least one of said remainder of said longitudinal filaments in each of said end portions.

17. The combination as set forth in claim 16, wherein said rod is made of plastic.

18. A method of making a fabric web for a drying section of a dewatering machine, said method comprising the steps of providing at least two interwoven fabric layers formed of longitudinal and transverse filaments, one of the fabric layers having a zone free of transverse filaments spaced from and parallel to a leading edge thereof, and said layers being separated from each other between said zone and the leading edges thereof;

introducing a plurality of longitudinal filaments of greater cross-section than the remainder of the longitudinal filaments in said layers into said one fabric layer upstream of said zone to extend through said zone and thence into the other layer downstream of said zone;

removing a portion of said one layer adjacent the leading edge thereof;

folding back an end portion of said other layer containing said filaments of greater cross-section into overlapping relation with said zone of said first layer to cause the folded back longitudinal filaments of greater cross-section therein to form spaced apart curved connecting members; and joining said end portion of said other layer and said folded back filaments of greater cross-section contained therein to said one layer.

19. The method as set forth in claim 18, wherein at least one of the remainder of the longitudinal filaments in said one fabric layer is replaced by said plurality of longitudinal filaments of greater cross-section introduced into said one fabric layer.

20. A method as set forth in claim 19, wherein said other layer has a zone free of transverse filaments spaced from and parallel to a leading edge thereof and disposed in overlapping relation with said zone of said one layer and which further comprises the step of manually inserting at least one transverse filament through said overlapped zones to join said end portion of said other layer to said one layer.

21. A method as set forth in claim 20 which includes the further step of joining the remainder of the folded end portion of said other layer to said one layer.

22. A method as set forth in claim 21, wherein the web has three fabric layers with said one layer being a middle layer, and which further comprises the steps of providing said middle layer with a linen weave at said leading edge thereof;

folding back said middle layer at said leading edge thereof prior to folding back of said other layer; and securing the folded back portion of said middle layer to the remainder of said middle layer.

* * * * *